US005307786A

United States Patent [19]

Murata et al.

[11] Patent Number: 5,307,786

[45] Date of Patent: May 3, 1994

[54] IGNITION APPARATUS FOR AN INTERNAL COMBUSTION ENGINE

[75] Inventors: Shigemi Murata; Masayuki Ikeuchi, both of Himeji, Japan

[73] Assignee: Mitsubishi Denki Kabushiki Kaisha, Tokyo, Japan

[21] Appl. No.: 21,588

[22] Filed: Feb. 24, 1993

Related U.S. Application Data

[62] Division of Ser. No. 773,450, Oct. 9, 1991, Pat. No. 5,239,973.

[30] Foreign Application Priority Data

Oct. 12, 1990 [JP] Japan ..... 2-272107
Oct. 12, 1990 [JP] Japan ..... 2-272110

[51] Int. Cl.[5] ..... F02P 3/02

[52] U.S. Cl. ..... 123/635; 123/643; 123/647

[58] Field of Search ..... 123/647, 635, 425, 643

[56] References Cited

U.S. PATENT DOCUMENTS

| | | | |
|---|---|---|---|
| 4,648,367 | 3/1987 | Gillbrand et al. | 123/425 |
| 4,706,639 | 11/1987 | Boyer et al. | 123/647 |
| 5,058,559 | 10/1991 | Koiwa | 123/647 |
| 5,067,462 | 11/1991 | Iwata et al. | 123/425 |
| 5,087,882 | 2/1992 | Iwata | 123/425 |

*Primary Examiner*—Andrew M. Dolinar

*Attorney, Agent, or Firm*—Sughrue, Mion, Zinn, Macpeak and Seas

[57] ABSTRACT

An ignition apparatus for an internal combustion engine includes a reduced number of component parts which can be arranged or laid out without difficulty within a limited space such as a vehicle engine room. The apparatus can be manufactured at low costs and it is also highly resistant to electrical noise from adjacent electrical and electronic elements and hence has improved reliability in operation. The apparatus includes an ignition coil connected to a spark plug which has electrodes present in a combustion chamber of a cylinder, a switch unit for controlling power supply to the ignition coil, and an ion current sensing unit connected to the spark plug for sensing an ion current generated between the electrodes of the spark plug during combustion of a mixture in the combustion chamber. The ignition coil and the switch unit, or the ion current sensing unit and the switch unit, or all of these elements, are integrally formed with each other to provide an integral assembly. In a preferred form, the switch unit and the ion current sensing unit comprise a hybrid integral circuit. The switch unit includes a switch in the form of a power transistor connected to the ignition coil, and a switch driver for driving the switch. The power transistor can be formed separately from the ion current sensing unit whereas the switch driver can be integrally formed with the ion current sensing unit.

2 Claims, 5 Drawing Sheets

IGNITION APPARATUS FOR AN INTERNAL COMBUSTION ENGINE

This is a divisional of application Ser. No. 07/773,450 filed Oct. 9, 1991, now U.S. Pat. No. 5,239,973.

BACKGROUND OF THE INVENTION

The present invention relates to an ignition apparatus for an internal combustion engine which is particularly compact, small-sized and highly resistant to electrical noise.

FIG. 4 illustrates a typical example of a known ignition apparatus for a multi-cylinder internal combustion engine. In this Figure, a plurality of ignition coils 1 are provided one for each cylinder 9 of the engine, and each of the ignition coils 1 has a primary winding and a secondary winding. The primary winding of each ignition coil 1 is connected at one end thereof to a power supply such as a storage battery (not shown) and at the other end thereof to ground through a switch 2 in the form of a power transistor. The secondary winding of each ignition coil 1 is connected at one end thereof to ground and at the other end thereof to a signal take-out assembly 7 and to a corresponding spark plug 8 which is mounted on the head of a cylinder 9 with its electrodes present in a combustion chamber 9*a* defined therein. Each ignition coil 1 is mounted through fastening means 4 such as screws on a cylinder block 5 atop a corresponding spark plug 8. The power transistors 2 are controlled to be turned on and off by a computerized engine control unit (ECU) 3 which is connected to receive an output signal of a signal generator 10. The signal generator 10 generates an output signal representative of crank positions of pistons 9*b* received in the cylinders 9 in synchronism with the rotation of a crankshaft (not shown) connected through piston rods to the pistons 9*b*. The ECU 3 also receives output signals of various sensors (not shown) such as a throttle sensor, an intake pressure sensor, an engine speed sensors, an engine temperature sensor, ect. for properly controlling various aspects of engine operation including the ignition timing of the respective cylinders based on the sensor outputs. When a power transistor 2 is turned off by the ECU 3, a high ignition voltage is developed across the secondary winding of a corresponding ignition coil 1 and fed to a corresponding spark plug 8, as shown by an arrow 13, so that a spark is generated between the electrodes of the spark plug 8 to fire an air/fuel mixture in the combustion chamber 9*a* in a corresponding cylinder 9. The signal take-out assembly 7 includes an ion current sensing diode 6 which has an anode connected to the spark plug 8 and a cathode connected to an ion current sensing unit 11 for sensing an ion current generated in a gap between the electrodes of the spark plug 8 during or immediately after the combustion of the mixture. The ion current thus generated is fed from the spark plug 8 to the ion current sensing unit 11 through the ion current sensing diode 6, as indicated by an arrow 15. The ion current sensing unit 11 is formed separately from the switches 2 and the ignition coils 1 and housed in a metal casing. The ion current sensing unit 11 includes a signal processor 12 connected to the spark plugs 8 through a resistor 16, a capacitor 17 in the unit 11 and the respective diodes 6 in the signal take-out assemblies 7 for generating an output signal when an ion current input thereto exceeds a prescribed level, the output signal of the signal processor 12 being fed to the ECU 3, as shown by an arrow 18. The ion current sensing unit 11 further includes: a plurality of parallel circuits respectively connected at their one ends to the primary windings of the corresponding ignition coils 1 through a wire harness 14, these parallel circuits each comprising a resistor 19, a capacitor 20, a diode 21 and a diode 22 connected to each other as shown in FIG. 4; a capacitor 23 connected at one end thereof to ground and at the other end thereof to a junction 24 at which the other ends of the parallel circuits are connected together; and a resistor 25 connected at one end thereof to the junction 24 and at the other end thereof to one end of the capacitor 17 of which the other end is connected the signal processor 12. Upon deenergization of a power transistor 2, there is generated across the primary winding of a corresponding ignition coil 1 a positive voltage in the form of a pulse, as shown at (a) in FIG. 5, which is fed to the ion current sensing unit 11 where it is differentiated by the corresponding resistor 19 and the capacitor 20 to provide a differentiated voltage, as shown at (b) in FIG. 5, which is then fed through the corresponding diode 22 to the capacitor 23. The capacitor 23 provides at the junction 24 a negative voltage $-Vo$ having a waveform, as shown at (c) in FIG. 5, which acts as a negative voltage source. The ignition coils 1, the power transistors 2, the spark plugs 8 and the ion current sensing unit 11 are separately formed from each other.

In operation, when the ECU 3 turns off one of the power transistors 2 for cylinder #1, for example, at appropriate timing, the power supply to the primary winding of the ignition coil 1 for cylinder #1 is cut off so that there is generated a high voltage across the secondary winding of the ignition coil 1 which is fed to the corresponding spark plug 8 through the corresponding diode assembly 7. As a result, the spark plug 8 generates a spark between the electrodes thereof whereby an air/fuel mixture in the combustion chamber 9*a* in the corresponding cylinder 9 is fired to combust. In this case, the high negative voltage thus generated across the secondary winding of the spark plug 8 is not transmitted to the ion current sensing unit 11 since the capacitor 23 acts as a negative voltage source, as referred to before. During the combustion of the mixture, there is developed an ion current in a gap between the electrodes of the spark plug 8 which is then fed through the corresponding diode 6 to the ion current sensing unit 11, as indicated by the arrow 15, which is biased to a negative voltage. The signal processor 12 processes the ion current thus fed to the ion current sensing unit 11 and generates an ion current sensing signal to the ECU 3 which determines, based on the ion current sensing signal and the crank angle signal from the signal generator 10, whether normal combustion takes place in cylinder #1.

With the above-described known ignition apparatus, the ignition coils 1, the power transistors 2, the spark plugs 8 and the ion current sensing unit 11 are all separately formed from each other and electrically connected to each other through wiring or wiring harnesses. Accordingly, in cases where the ignition apparatus is mounted in a generally narrow space such as an engine room of a motor vehicle, the entire dimensions of the above component elements become substantial and require a relatively large installation space, making it difficult to properly arrange them within the narrow engine room. In addition, the known ignition apparatus includes many discrete component elements, which results in reduced reliability in operation.

Moreover, due to limited space availability inside the vehicle engine room, the ion current sensing unit 11 has sometimes to be disposed remote from the other elements such as the ignition coils 1, the switches 2, etc., of the ignition apparatus, and it is connected to the primary windings of the ignition coils 1 and to the spark plugs 8 through the diode assemblies 7 by way of the relatively long wire harness 14 and wiring 26, which are liable to be subject to influences of electrical noise from various other electrical and electronic elements or devices disposed in the engine room. In addition, if the wire harness 14 connecting between the ion current sensing unit 11 and the ignition coils 1 is disposed in the vicinity of the wiring 26 connecting between the ion current sensing unit 11 and the diode assemblies 7, the wire harness 14, through which a high voltage passes from the primary windings of the ignition coils 1 to the ion current sensing unit 11, becomes a noise source whereas the wiring 26, through which a relatively weak ion current passes, becomes a noise recipient. As a result, the ion current in the wiring 26 tends to include electrical noise due to influences from a high voltage in the wire harness 14.

SUMMARY OF THE INVENTION

Accordingly, the present invention is intended to overcome the above-mentioned problems encountered with the known ignition apparatus.

An object of the present invention is to provide a novel and improved ignition apparatus for an internal combustion engine which includes a reduced number of component parts which can be arranged or laid out without difficulty within a limited space such as a vehicle engine room, and which can be manufactured at low costs.

Another object of the present invention is to provide a novel and improved ignition apparatus for an internal combustion engine which is highly resistant to electrical noise from adjacent electrical and electronic elements and hence has improved reliability in operation.

In order to achieve the above objects, according to one aspect of the present invention, there is provided an ignition apparatus for an internal combustion engine comprising: an ignition coil connected to a spark plug which has electrodes present in a combustion chamber of a cylinder; and an ion current sensing unit connected to the spark plug for sensing an ion current generated between the electrodes of the spark plug during combustion of a mixture in the combustion chamber, the ion current sensing unit being integrally formed with the ignition coil.

According to another aspect of the invention, there is provided an ignition apparatus for an internal combustion engine comprising: an ignition coil connected to a spark plug which has electrodes present in a combustion chamber of a cylinder; a switch for controlling power supply to the ignition coil; and an ion current sensing unit connected to the spark plug for sensing an ion current generated between the electrodes of the spark plug during combustion of a mixture in the combustion chamber. The ignition coil, the switch and the ion current sensing unit are integrally formed with each other to provide an integral assembly.

According to a further aspect of the invention, there is provided an ignition apparatus for an internal combustion engine comprising: an ignition coil connected to a spark plug which has electrodes present in a combustion chamber of a cylinder; a switch unit for controlling power supply to the ignition coil; and an ion current sensing unit connected to the spark plug for sensing an ion current generated between the electrodes of the spark plug during combustion of a mixture in the combustion chamber, the ion current sensing unit being integrally formed with the switch unit to provide an integral assembly.

In a preferred embodiment, the switch unit and the ion current sensing unit comprise a hybrid integral circuit.

Preferably, the switch unit includes a switch connected to the ignition coil, and a switch driver for driving the switch. The switch is formed separately from the ion current sensing unit whereas the switch driver is integrally formed with the ion current sensing unit.

The above and other objects, features and advantages of the invention will be more readily apparent from the following detailed description of a few preferred embodiments of the invention, taken in conjunction with the accompanying drawings.

BRIEF DESCRIPTION OF THE DRAWINGS

In the drawings, the same or corresponding elements are identified by the same symbols.

DESCRIPTION OF THE PREFERRED EMBODIMENTS

A few preferred embodiments of the invention will now be described in detail while referring to the accompanying drawings.

Figure 1:
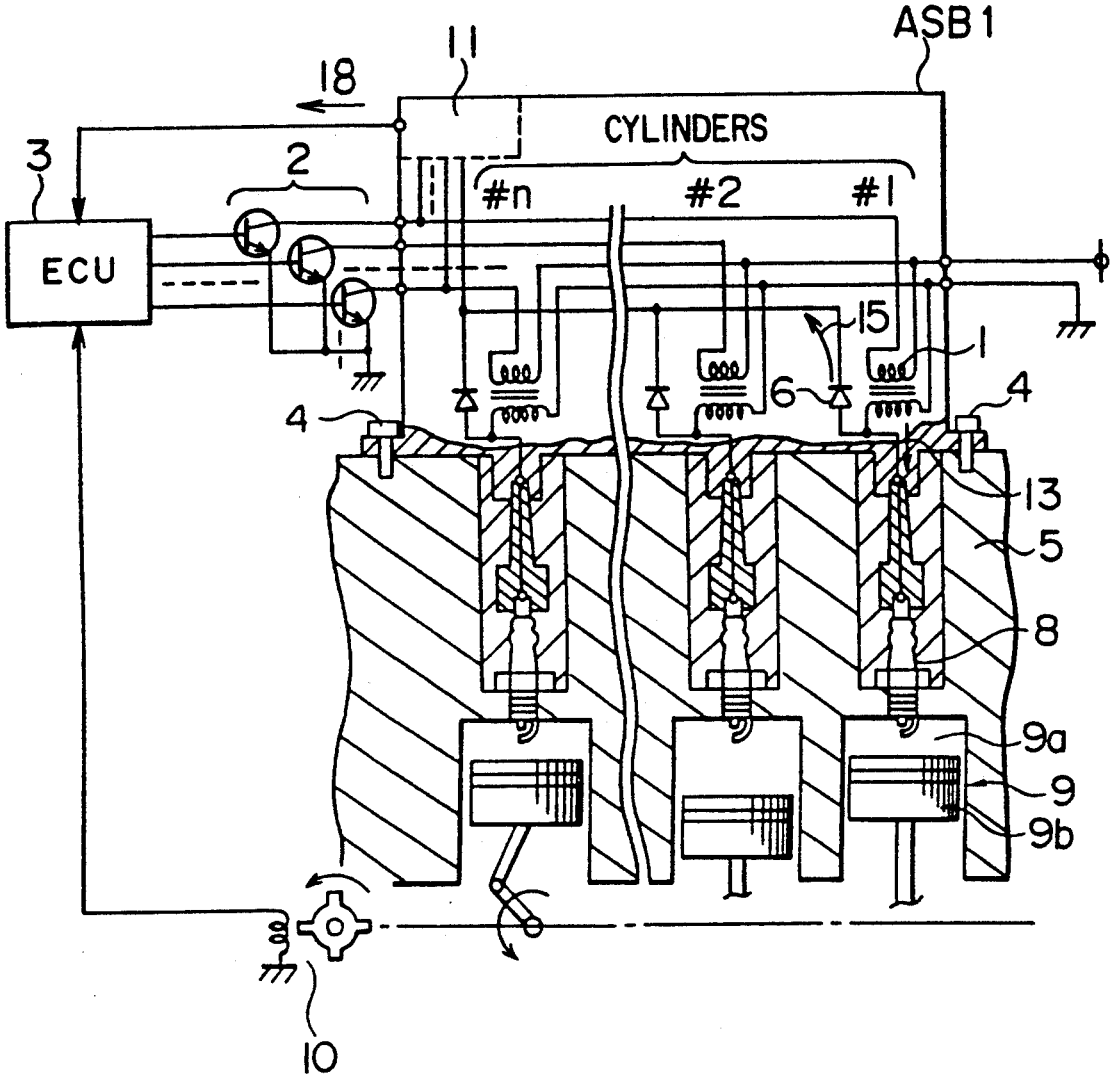
FIG. 1 is a schematic diagram showing an ignition apparatus as applied to a multi-cylinder internal combustion engine in accordance with the present invention.
Figure 4:
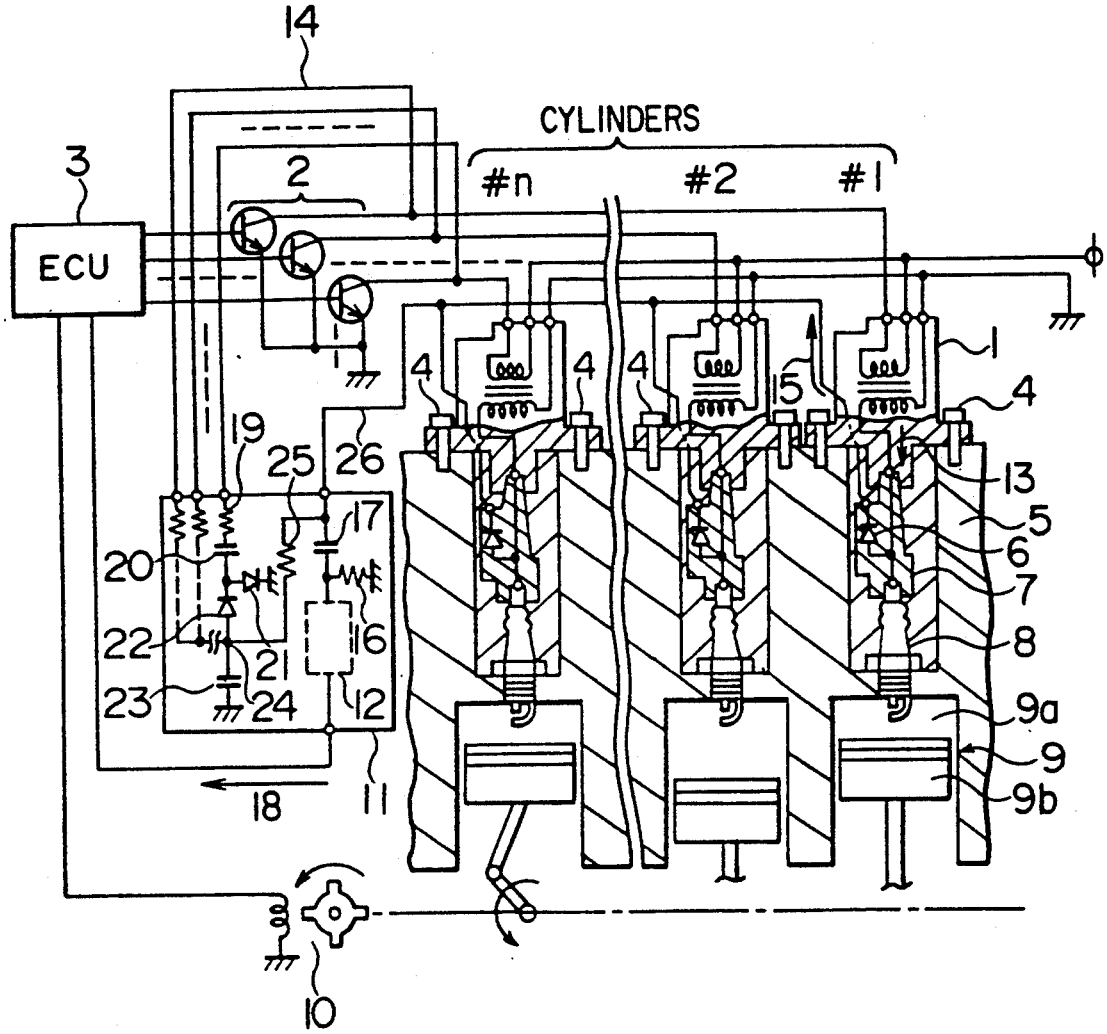
FIG. 4 PRIOR ART
FIG. 4 is a view similar to FIG. 1, but showing a known ignition apparatus for a multi-cylinder internal combustion engine.
Figure 5:
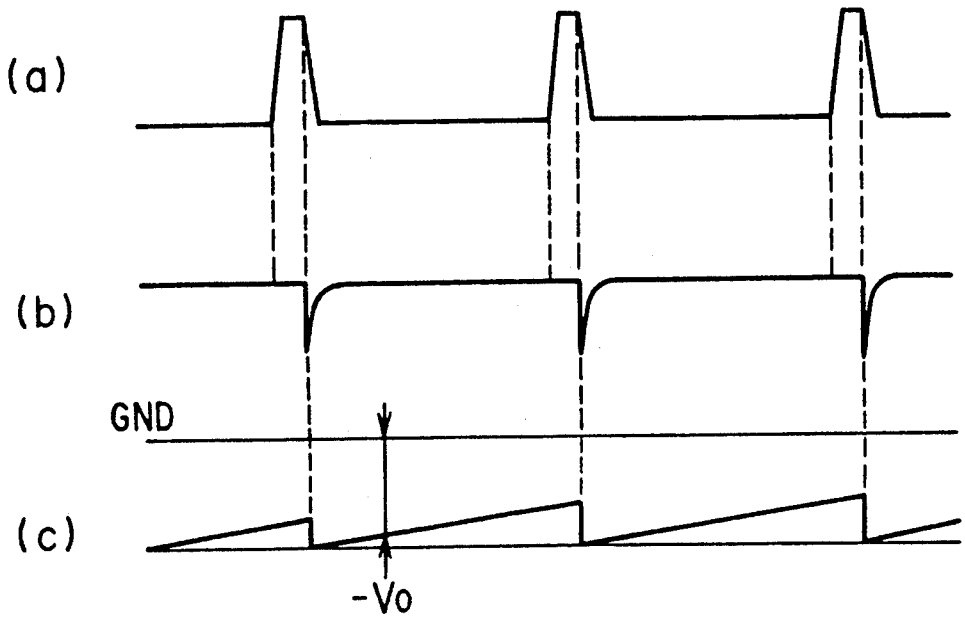
FIG. 5 is a waveform diagram showing waveforms of voltages at various portions of the ignition apparatus of FIG. 4.

Referring to the drawings and first to FIG. 1, there is schematically illustrated an ignition apparatus for a multicylinder internal combustion engine. The illustrated ignition apparatus is substantially similar in construction and operation to the known ignition apparatus of FIG. 4 except for the following features. Specifically, in this embodiment, a plurality of ignition coils 1 and an ion current sensing unit 11 are housed in a single case and hence formed integral with each other to form a single compact assembly ASB1. With this arrangement, the ion current sensing unit 11 can be disposed at a location near the ignition coils 1 within a single casing (not shown) so that it is electrically connected to primary windings of the ignition coils 1 through wiring of a short length without using a relatively long wire harness as in the known ignition apparatus of FIG. 4. The short wiring connecting between the ignition coils 1 and the unit 11 is rarely influenced by or substantially free from electrical noise from neighboring electric or electronic elements, so the unit 11 can accurately determine, based on an ion currents fed thereto from the spark plugs 8, whether normal combustion takes place in the cylinders 9. The single compact assembly ASB1 can be mounted on a cylinder block 5 with ease through a reduced number of fastening means 4 such as screws as compared with the case in which a plurality of ignition coils are individually mounted on the cylinder block 5, as shown in FIG. 4. Thus, the number of component parts such as fastening screws 4 can be reduced to facilitate the installation and manufacture of the ignition coils 1 and the ion current sensing unit 11.

Figure 2:
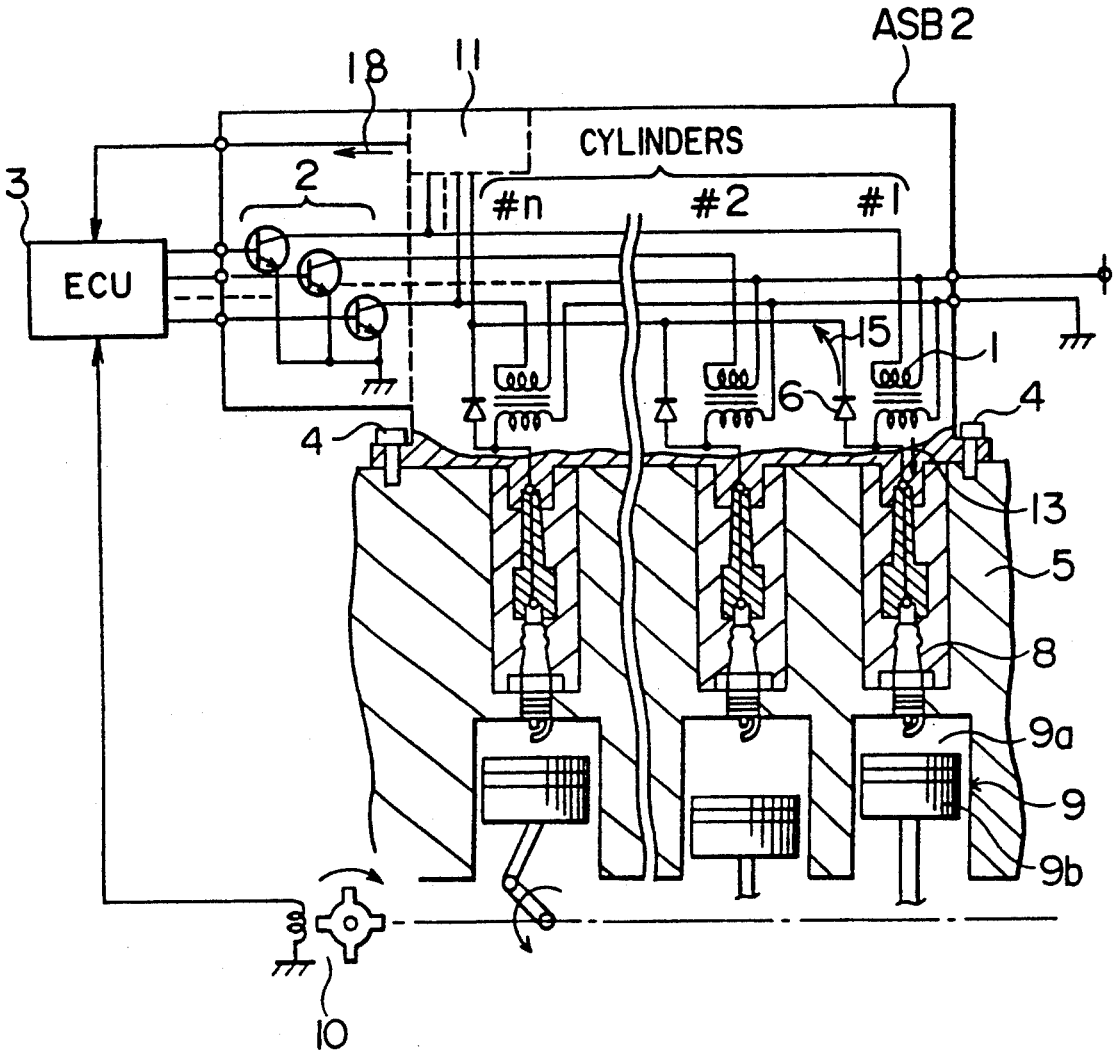
FIG. 2 is a view similar to FIG. 1, but showing another embodiment of the invention.

FIG. 2 illustrates another embodiment of the invention which is substantially similar in arrangement and operation to the first embodiment of FIG. 1 except for the fact that a plurality of switches 2 in the form of power transistors are integrally formed with a plurality of ignition coils 1 and an ion current sensing unit 11 to provide an integral assembly ASB2. The ignition coils 1, the switches 2 and the ion current sensing unit 11 can be housed in a single casing. This arrangement serves to further reduce the entire dimensions of these elements and the number of component parts such as fastening screws 4 required as well as to further facilitate the mounting thereof.

Figure 3:
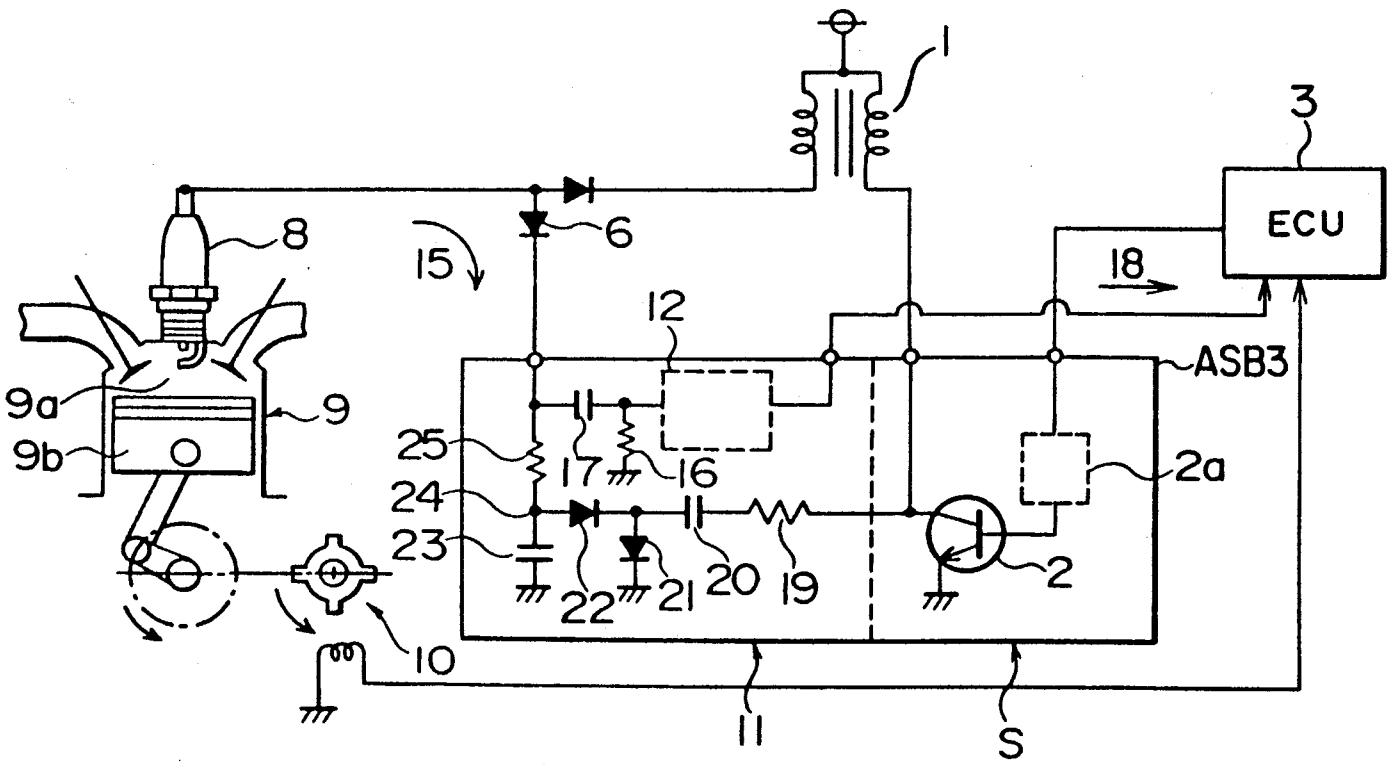
FIG. 3 is a schematic diagram showing an ignition apparatus for an internal combustion engine in accordance with a further embodiment of the invention.

FIG. 3 shows a further embodiment of the invention. Although in this figure, for the sake of simplification in explanation, only a single ignition coil 1 with a spark plug 8 for a cylinder 9 is illustrated, there are actually a plurality of these elements as in the embodiments of FIGS. 1 and 2. Apart from this, this embodiment is also substantially similar in arrangement and operation to the first-mentioned embodiment of FIG. 1 except for the following features. Specifically, in this embodiment, an ion current sensing unit 11, which is substantially the same as that of FIG. 4, is integrally formed with a switch unit S to form an integral assembly ABS3. The switch unit S includes a plurality of switches 2 in the form of power transistors (only one is illustrated) each connected to a primary winding of a corresponding ignition coil 1 and to the ion current sensing unit 11, and a switch driver 2*a* connected between the switches 2 and an ECU 3 for selectively turning the switches 2 on and off on the basis of a control signal from the ECU 3. The ion current sensing unit 11 and the switch unit S can be constituted by a hybrid integrated circuit (HIC). In this case, each of the power transistors 2, through which a large primary winding current flows, can be formed into a discrete element separated from all the other elements of the ion current sensing unit 11 and the switch unit S. In this embodiment, too, substantially the same advantages are obtained as in the embodiments of FIGS. 1 and 2.

What is claimed is:

1. An ignition apparatus for an internal combustion engine, comprising:

a) a plurality of ignition coils individually connected to an equal plurality of spark plugs which have electrodes present in combustion chambers of cylinders;

b) a switch (S) having an equal plurality of switches (2) for individually controlling power supply to said ignition coils; and c) an ion current sensing unit connected to said spark plugs for sensing ion currents generated between the electrodes of said spark plugs during combustion of a mixture in the combustion chambers, d) wherein said ion current sensing unit is integrally formed with said switch unit to provide an integral assembly (ASB3), wherein said switch unit and said ion current sensing unit comprise a hybrid integrated circuit, and wherein the ion current sensing unit is electrically connected to primary windings of the ignition coils without a wiring harness.

2. An ignition apparatus according to claim 1, wherein each switch (2) is connected to an associated ignition coil and formed separately from said ion current sensing unit, and said switch unit includes a switch drive (2*a*) for driving said switches, said switch driver being integrally formed with said ion current sensing unit.

* * * * *